US008881787B2

(12) United States Patent
Wang

(10) Patent No.: US 8,881,787 B2
(45) Date of Patent: Nov. 11, 2014

(54) RETRACTABLE SAFETY GATE

(71) Applicant: Tsung-Hsiang Wang, New Taipei (TW)

(72) Inventor: Tsung-Hsiang Wang, New Taipei (TW)

( * ) Notice: Subject to any disclaimer, the term of this patent is extended or adjusted under 35 U.S.C. 154(b) by 25 days.

(21) Appl. No.: 13/867,844

(22) Filed: Apr. 22, 2013

(65) Prior Publication Data

US 2013/0299101 A1 Nov. 14, 2013

(30) Foreign Application Priority Data

May 8, 2012 (CN) ..... 2012 2 0202875 U

(51) Int. Cl.

| | |
|---|---|
| ***E06B 9/56*** | (2006.01) |
| ***E06B 9/13*** | (2006.01) |
| ***E06B 11/04*** | (2006.01) |
| ***E06B 9/00*** | (2006.01) |
| ***E06B 9/60*** | (2006.01) |

(52) U.S. Cl.

CPC ... *E06B 9/60* (2013.01); *E06B 9/13* (2013.01); *E06B 11/04* (2013.01); *E06B 9/00* (2013.01); *E06B 2009/002* (2013.01)

USPC ..... 160/24; 160/302

(58) Field of Classification Search

USPC ..... 160/24, 296, 305, 309, 313, 301, 315, 160/323.1, 293.1, 23.1, 302, 290.1

See application file for complete search history.

(56) References Cited

U.S. PATENT DOCUMENTS

| | | | | |
|---|---|---|---|---|
| 5,690,317 | A * | 11/1997 | Sandsborg | 256/1 |
| 6,375,165 | B1 * | 4/2002 | Sherratt et al. | 256/24 |
| 6,536,502 | B2 * | 3/2003 | Britto et al. | 160/23.1 |
| 7,178,792 | B2 * | 2/2007 | Monahan et al. | 256/73 |
| 7,219,709 | B1 * | 5/2007 | Williams | 160/24 |
| 7,438,112 | B2 * | 10/2008 | Cheng | 160/24 |
| 8,191,604 | B2 * | 6/2012 | Wang | 160/296 |

FOREIGN PATENT DOCUMENTS

| | | |
|---|---|---|
| CN | 201439682 U | 4/2010 |

* cited by examiner

*Primary Examiner* — David Purol

(74) *Attorney, Agent, or Firm* — Muncy, Geissler, Olds & Lowe P.C.

(57) ABSTRACT

A retractable safety gate has a mounting assembly, a control assembly, a delaying assembly, an operating assembly, a blocking cloth, a grip assembly and a receiving assembly. The control assembly has a controller, a ratchet unit and a spiral spring. The spiral spring is connected between the controller and the ratchet unit. Thus, the controller is pulled back to the original position to be closed by the spiral spring, thereby reducing number of the components such that the retractable safety gate has a simplified structure.

10 Claims, 17 Drawing Sheets

RETRACTABLE SAFETY GATE

CROSS-REFERENCE TO RELATED APPLICATIONS

This application is based upon and claims priority under 35 U.S.C. 119 from China Patent Application No. 201222020287 filed on May 8, 2012, which is hereby specifically incorporated herein by this reference thereto.

BACKGROUND OF THE INVENTION

1. Field of the Invention

The present invention relates to a retractable safety gate, especially to a retractable safety gate that is installed at an entrance to household areas that might be unsafe to keep babies or toddlers from entering.

2. Description of the Prior Arts

A retractable safety gate is usually installed indoors to keep babies or toddlers from entering household areas that might be unsafe, such as kitchen, stairs, or bathrooms. The retractable safety gate may also be used to restrict pets within a particular area at home.

A conventional retractable safety gate has a mounting assembly, a receiving assembly and a blocking cloth. The mounting assembly and the receiving assembly are respectively mounted on two opposite walls. Normally, the blocking cloth is retracted into the mounting assembly. When the retractable safety gate is in use, the blocking cloth is pulled out to connect to the receiving assembly, thereby dividing a room into two separate spaces. A conventional retractable safety gate as disclosed in China utility model No. CN201439682U, which is incorporated herein as reference, comprises a mounting assembly, a spiral spring, a control assembly, a delaying assembly, an operating assembly, a blocking cloth and a receiving assembly. The spiral spring provides the blocking cloth with a torsion to retract the blocking cloth. The control assembly determines whether the blocking cloth can be pulled out. The operating assembly has a torsion spring to pull the control assembly to move back to an original position. The delaying assembly has a delaying unit. The delaying unit is comprised of fan blades or flywheel weights. By a resistance made between the fan blades and the air, or by the weights, the delaying unit provides a cushion force to slow down the control assembly's movement back to the original position.

When the conventional retractable safety gate is in use, the user switches on the operating assembly, thereby switching on the control assembly as well. After the control assembly is switched on, the blocking cloth can be moved freely. At this time, the blocking cloth can be pulled out to any position, or can be retracted to the mounting assembly by the spiral spring. Besides, after the control assembly is switched on, the torsion spring of the operating assembly and the delaying unit of the delaying assembly make the control unit slowly move back to the original position such that the control assembly is closed. The blocking cloth is easily to be adjusted in length as mentioned above. When the control assembly is closed, the blocking cloth cannot be moved and is held in position.

However, a structure of the conventional retractable safety gate, particularly the control assembly and the delaying assembly, is too complicated such that the retractable safety gate is hard to be manufactured, which also increases the manufacturing cost.

To overcome the shortcomings, the present invention provides a retractable safety gate to mitigate or obviate the aforementioned problems.

SUMMARY OF THE INVENTION

The main objective of the present invention is to provide a retractable safety gate that has a simplified structure.

The retractable safety gate has a mounting assembly, a control assembly, a delaying assembly, an operating assembly, a blocking cloth, a grip assembly and a receiving assembly. The control assembly has a controller, a ratchet unit and a spiral spring. The spiral spring is connected between the controller and the ratchet unit. Thus, the controller is pulled back to the original position to be closed by the spiral spring, thereby reducing number of the components such that the retractable safety gate of the present invention has a simplified structure.

Besides, a resistance assembly of the delaying assembly has a driving unit, two resistant units, a resistant cover and a resistant loop. The driving unit is pivotally connected to a delaying seat of the delaying assembly, and engages with an accelerating gear assembly of the delaying assembly. The resistant units are pivotally connected to the driving unit, and are disposed on two opposite sides of the driving unit. The resistant cover is mounted on the delaying seat, and covers the driving unit and the resistant units. The resistant loop is mounted around an inside wall of the resistant cover.

Therefore, when the accelerating gear assembly rotates the driving unit, the resistant units rotate relative to the driving unit by a centrifugal force. Accordingly the resistant units may abut against the resistant loop on the inside wall of the resistant cover, thereby generating an abrasion force. The abrasion force slows down the recovering movement of the controller. As a result, the resistance assembly can achieve the same function as a torsion spring, with reduced and simplified components.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
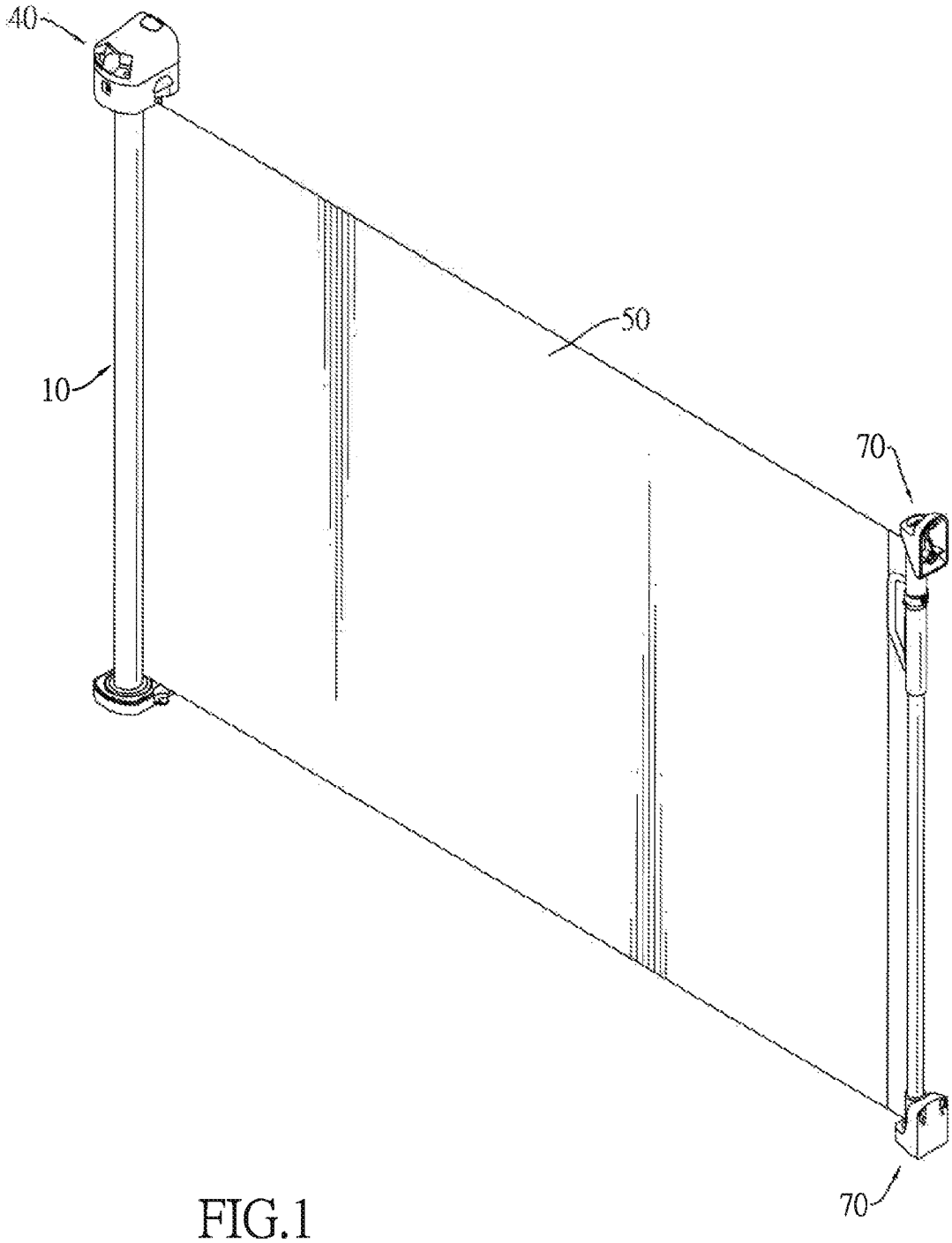
FIG. 1 is a perspective view of a retractable safety gate in accordance with the present invention.
Figure 2:
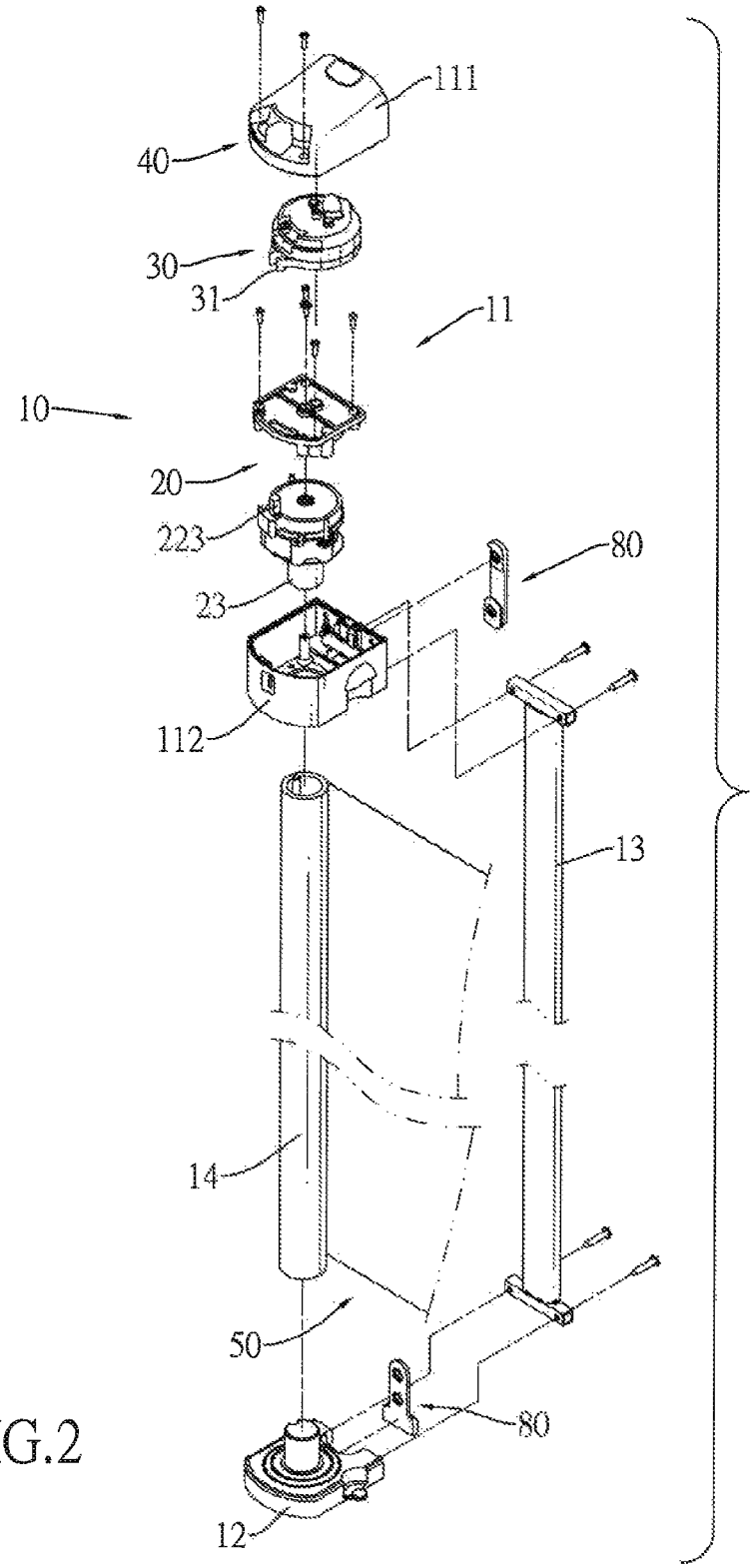
FIG. 2 is a partial exploded perspective view of the retractable safety gate in FIG. 1.

With reference to FIGS. 1 and 2, a retractable safety gate in accordance with the present invention comprises a mounting assembly 10, a control assembly 20, a delaying assembly 30, an operating assembly 40, a blocking cloth 50, a grip assembly 60, a receiving assembly 70 and a wall assembly 80.

Figure 3:
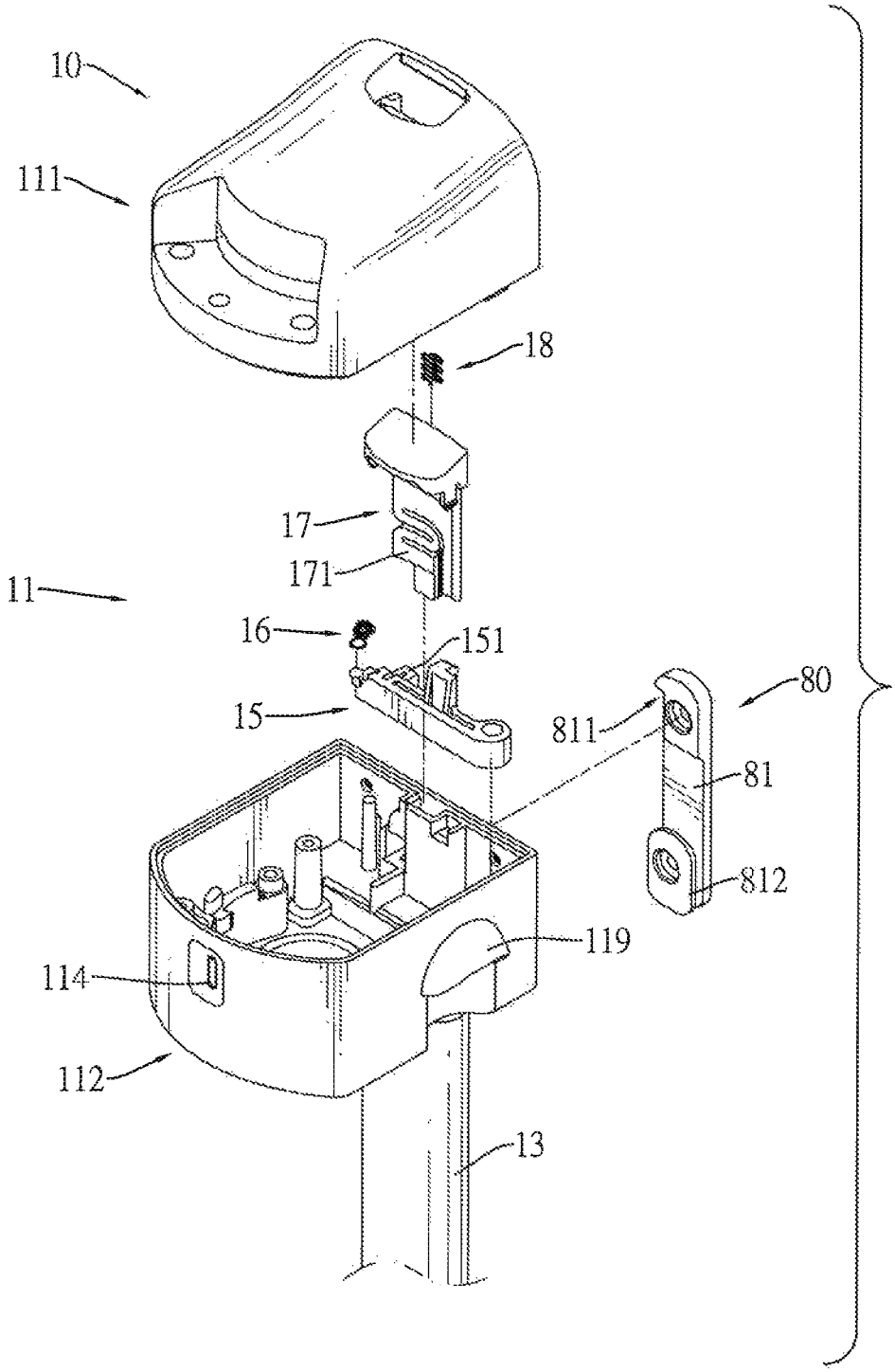
FIG. 3 is a partial exploded perspective view of a mounting assembly of the retractable safety gate in FIG. 1.
Figure 4:
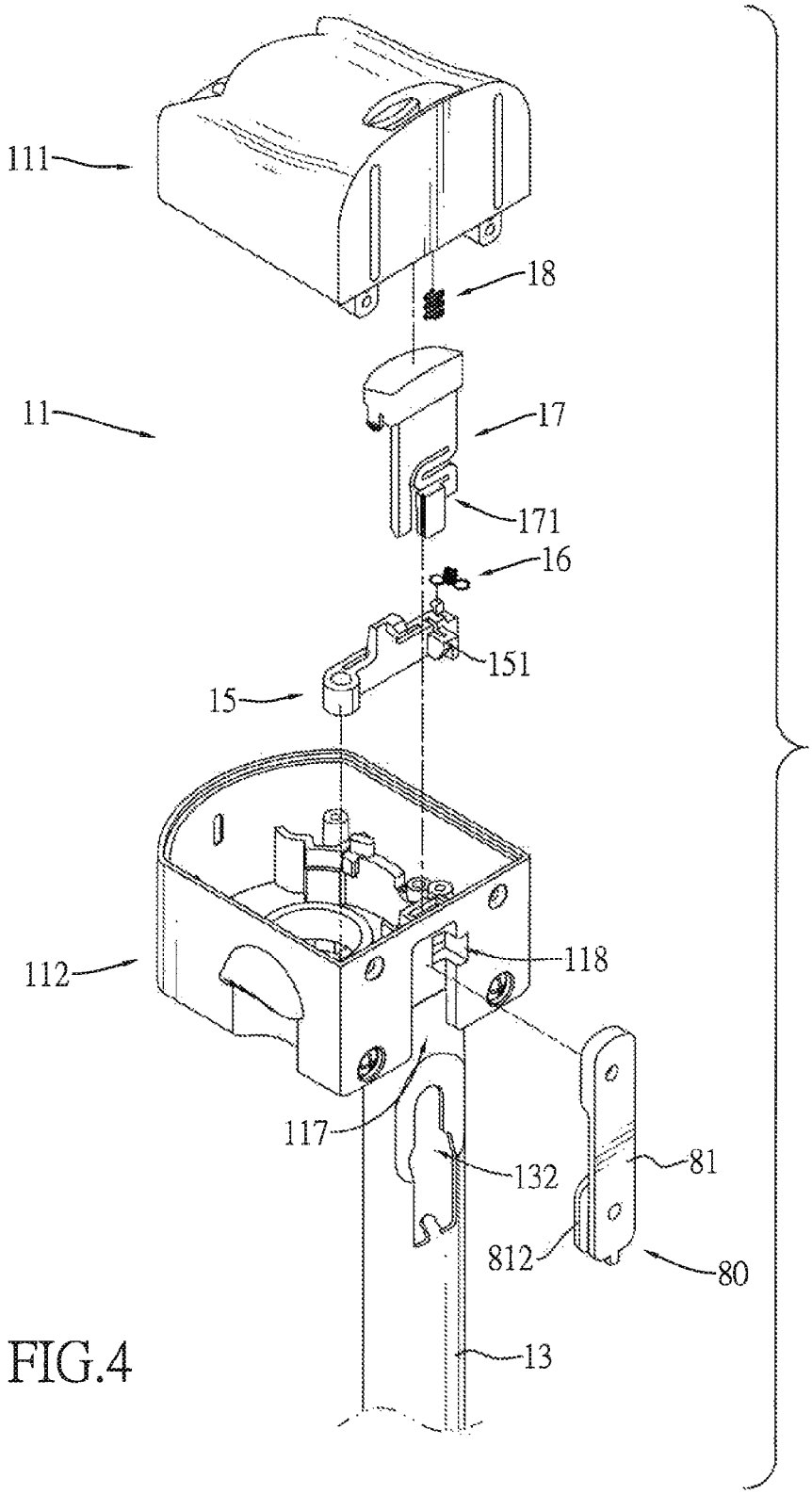
FIG. 4 is another partial exploded perspective view of the mounting assembly of the retractable safety gate in FIG. 1.

With reference to FIGS. 2 to 4, the mounting assembly 10 has a top casing 11, a bottom casing 12, a connecting unit 13 and a rotating shaft 14. The top casing 11 has a top cover 111, a top seat 112 and an inner space. The inner space is formed between the top cover 111 and the top seat 112. The bottom casing 12 is disposed below the top casing 11. The connecting unit 13 is connected between the top casing 11 and the bottom casing 12. The rotating shaft 14 is rotatably connected between the top casing 11 and the bottom casing 12.

Figure 5:
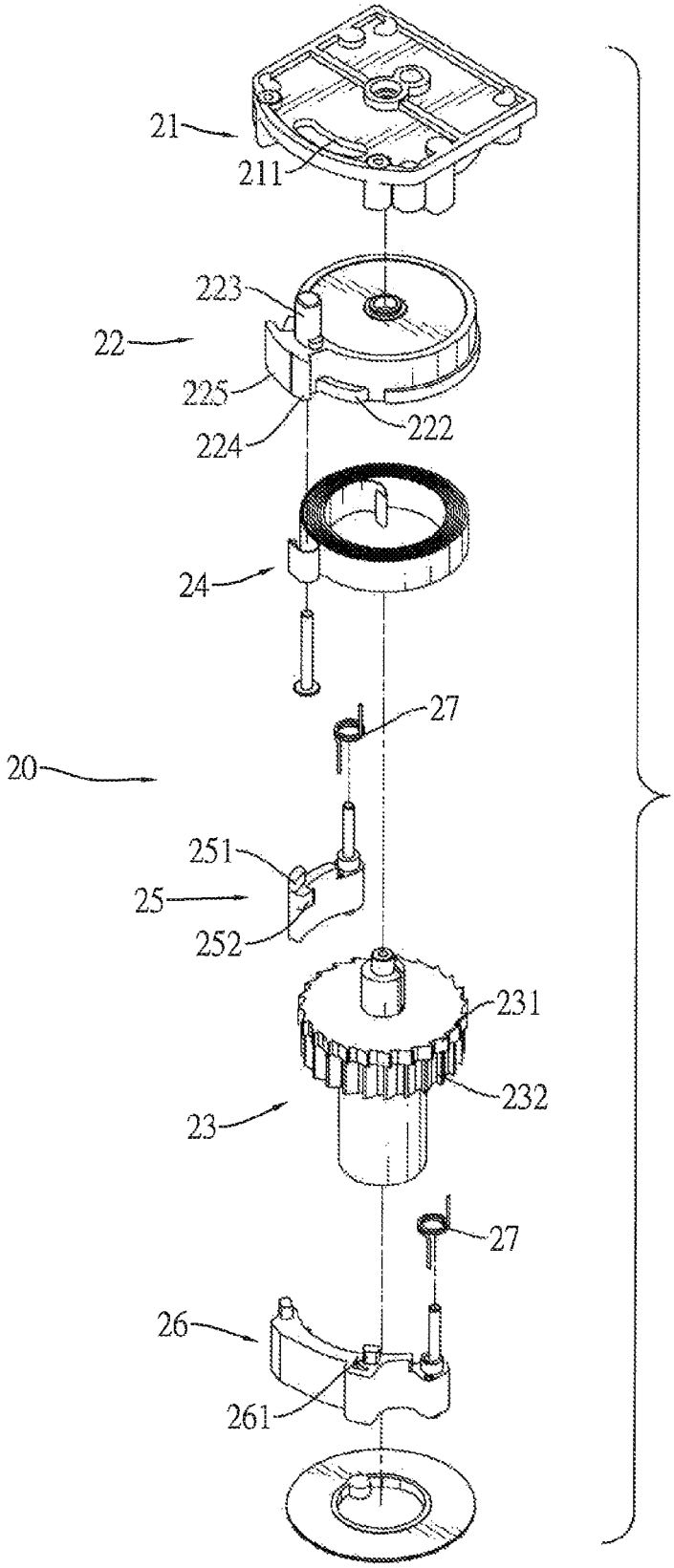
FIG. 5 is a partial exploded perspective view of a control assembly of the retractable safety gate in FIG. 1.
Figure 6:
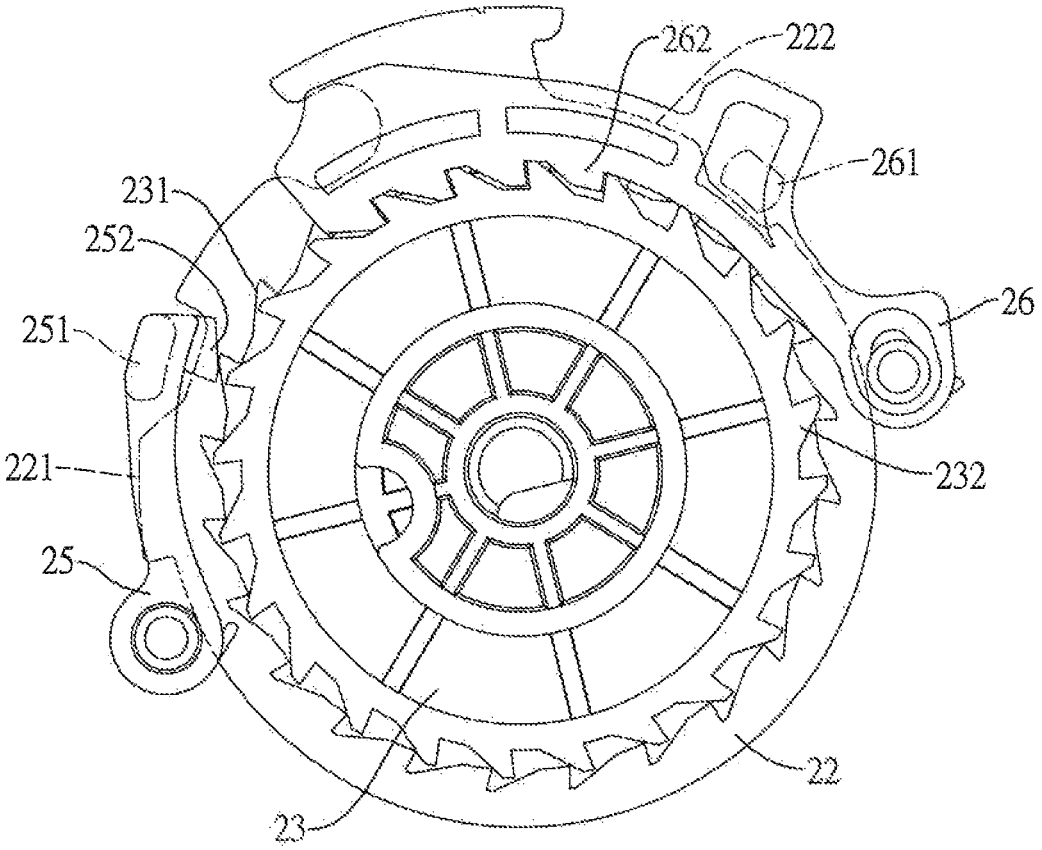
FIG. 6 is an operational view of the control assembly of the retractable safety gate in FIG. 1, showing a first arm and a second arm engaging with the ratchet unit.

With reference to FIGS. 2, 5 and 6, the control assembly 20 is mounted in the top casing 11 and has a control seat 21, a controller 22, a ratchet unit 23, a spiral spring 24, a first arm 25, a second arm 26 and two first resilient elements 27. The control seat 21 is mounted securely in the top seat 112, and has a curved hole 211 formed through the control seat 21. The controller 22 is pivotally connected to the control seat 21 and has a control pin 223, a first protrusion 221 and a second protrusion 222. The control pin 223 is formed upward axially on the controller 22, is mounted through and protrudes out of the curved hole 211 of the control seat 21. The first protrusion 221 and the second protrusion 222 are formed separately on an outside wall of the controller 22. The ratchet unit 23 is pivotally connected to the controller 22 and has a first loop ratchet 231 and a second loop ratchet 232. The first loop ratchet 231 and the second loop ratchet 232 are formed on an outside wall of the ratchet unit 23. The second loop ratchet 232 is formed below the first loop ratchet 231. A rotating direction of the second loop ratchet 232 is reverse to a rotating direction of the first loop ratchet 231. A bottom of the ratchet unit 23 is connected securely to the rotating shaft 14 of the mounting assembly 10. Two ends of the spiral spring 24 are each respectively connected to the controller 22 and the ratchet unit 23. The first arm 25 and the second arm 26 are pivotally connected to the controller 22. The first arm 25 has a first engager 251 and a first stopper 252. The first engager is formed axially on the first arm 25, and selectively abuts the first protrusion 221 of the controller 22. The first stopper 252 is formed transversely on an inside wall of the first arm 25, and selectively engages with the first loop ratchet 231 of the ratchet unit 23. The second arm 26 has a second engager 261 and a second stopper 262. The second engager 261 is formed axially on the second arm 26, and selectively abuts the second protrusion 222 of the controller 22. The second stopper 262 is formed transversely on an inside wall of the second arm 26, and selectively engages with the second loop ratchet 232 of the ratchet unit 23. Two sides of one of the first resilient elements 27 each respectively abut the control seat 21 and the first arm 25. Two sides of the other first resilient element 27 each respectively abut the control seat 21 and the second arm 26. In a preferred embodiment, the first resilient elements 27 are torsion springs.

Because one of the ends of the spiral spring 24 is connected to the controller 22, the controller 22 is pulled by the spiral spring 24 and rotates until the control pin 223 abut an end portion of the curved hole 211 of the control seat 21. At this time, the first protrusion 221 does not abut the first engager 251 and the second protrusion 222 does not abut the second engager 261. Thus, the first resilient elements 27 each respectively push the first arm 25 and the second arm 26, such that the first stopper 252 engages with the first loop ratchet 231, and the second stopper 262 engages with the second ratchet 232 of the ratchet unit 23. Therefore, the ratchet unit 23 cannot rotate in two reverse directions. Because the ratchet unit 23 is connected securely to the rotating shaft 14 of the mounting assembly 10, the rotating shaft 14 cannot rotate, either.

Figure 7:
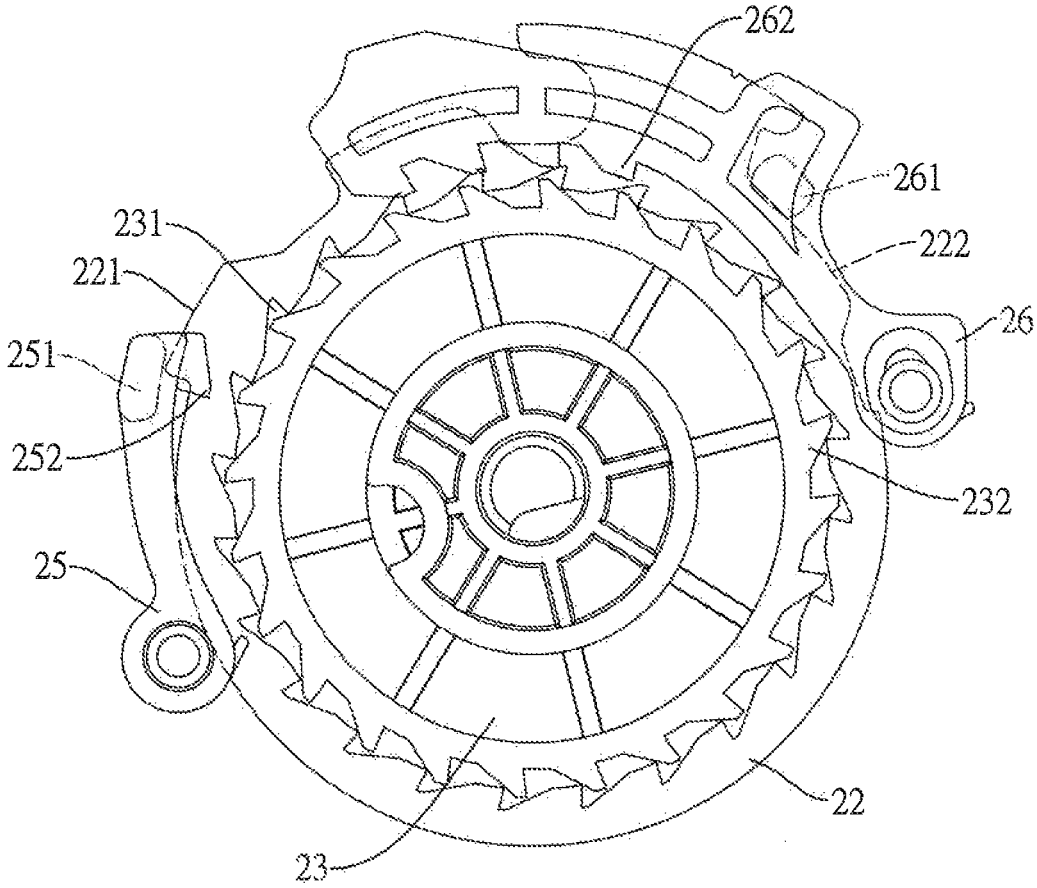
FIG. 7 is another operational view of the control assembly of the retractable safety gate in FIG. 1, showing the first arm and the second arm disengaging from the ratchet unit.

With reference to FIGS. 2, 5 and 7, the controller 22 is rotated by an external force and presses the spiral spring 24, and the control pin 223 abuts the other end portion of the curved hole 211 of the control seat 21. At this time, the first protrusion 221 abuts and rotates the first engager 251 of the first arm 25, and the second protrusion 222 abuts and rotates the second engager 261 of the second arm 26, such that the first stopper 252 of the first arm 25 and the second stopper 262 of the second arm 26 each respectively disengage from the first loop ratchet 231 and the second ratchet 232 of the ratchet unit 23 to allow the ratchet unit 23, which is connected with the rotating shaft 14, to rotate freely.

Once the external force applied on the controller 22 is removed, the controller 22 is pulled by the spiral spring 24 and rotates back to an original position.

With reference to FIGS. 3 and 5, the top seat 112 of the top casing 11 has a display hole 114. The display hole 114 is formed through a front wall of the top seat 112. The controller 22 of the control assembly 20 has a first displaying segment 224 and a second displaying segment 225. The first displaying segment 224 and the second displaying segment 225 are formed on the outside wall of the controller 22 and correspond to the display hole 114 of the top seat 112. The first displaying segment 224 and the second displaying segment 225 are transversely adjacent to each other. A color of the first displaying segment 224 is different from a color of the second displaying segment 225. Thus, the user can identify whether the controller 22 is under an external force by the display hole 114 showing either the first displaying segment 224 or the second displaying segment 225. Accordingly, the user can further know whether the rotating shaft 14 is rotatable or not from the display hole 114.

Figure 8:
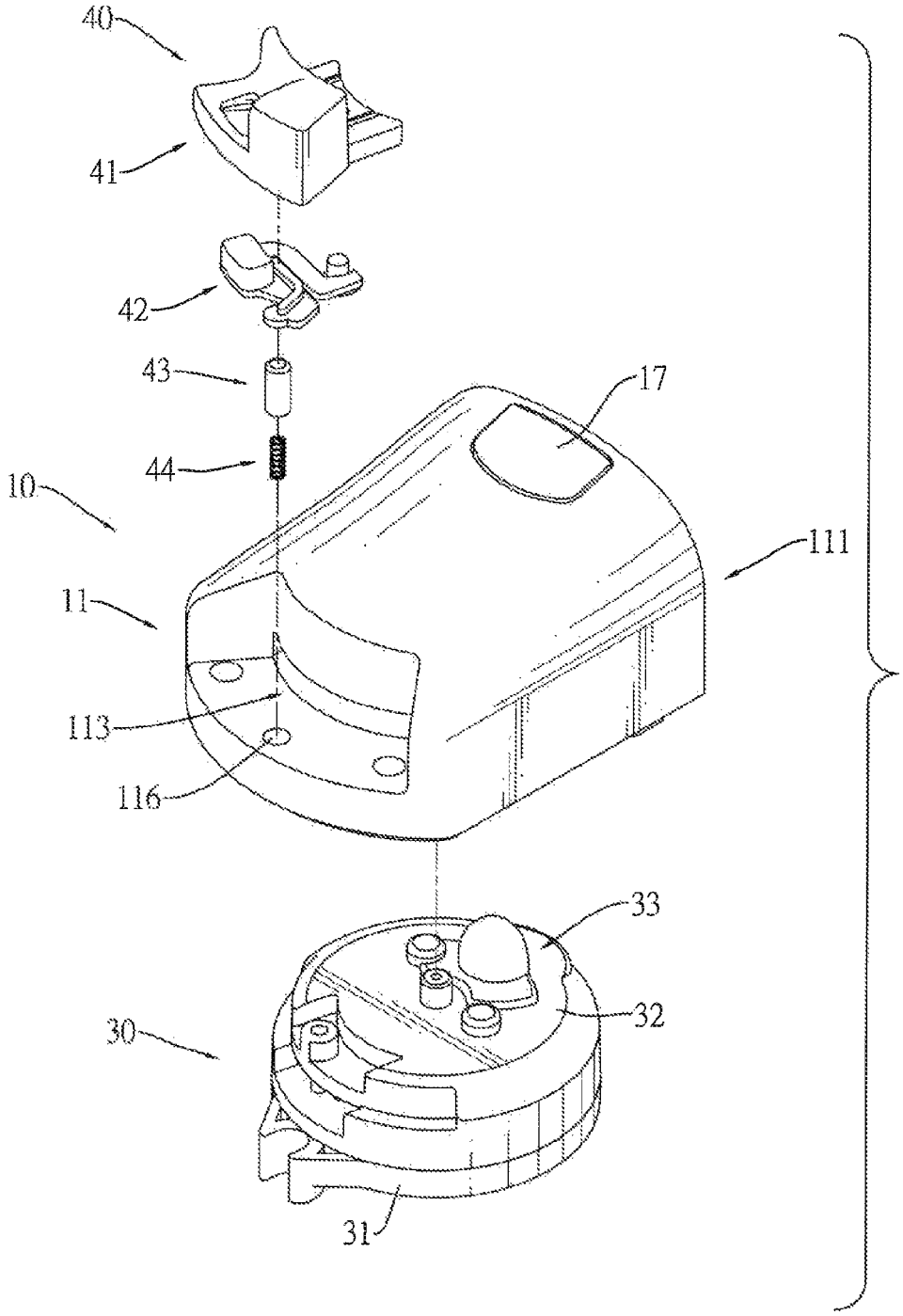
FIG. 8 is an exploded perspective view of an operating assembly of the retractable safety gate in FIG. 1.
Figure 9:
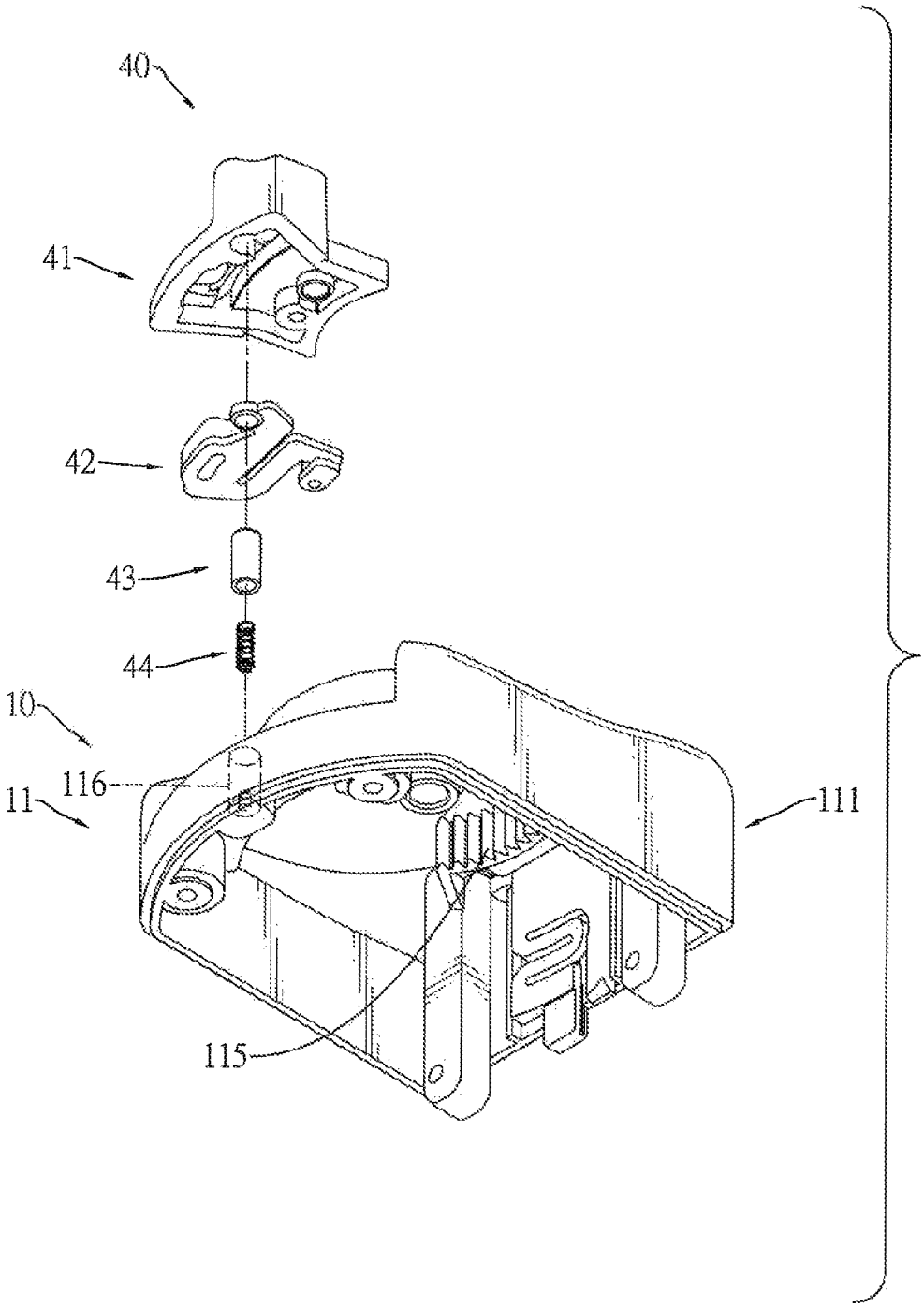
FIG. 9 is another exploded perspective view of the operating assembly of the retractable safety gate in FIG. 1.
Figure 10:
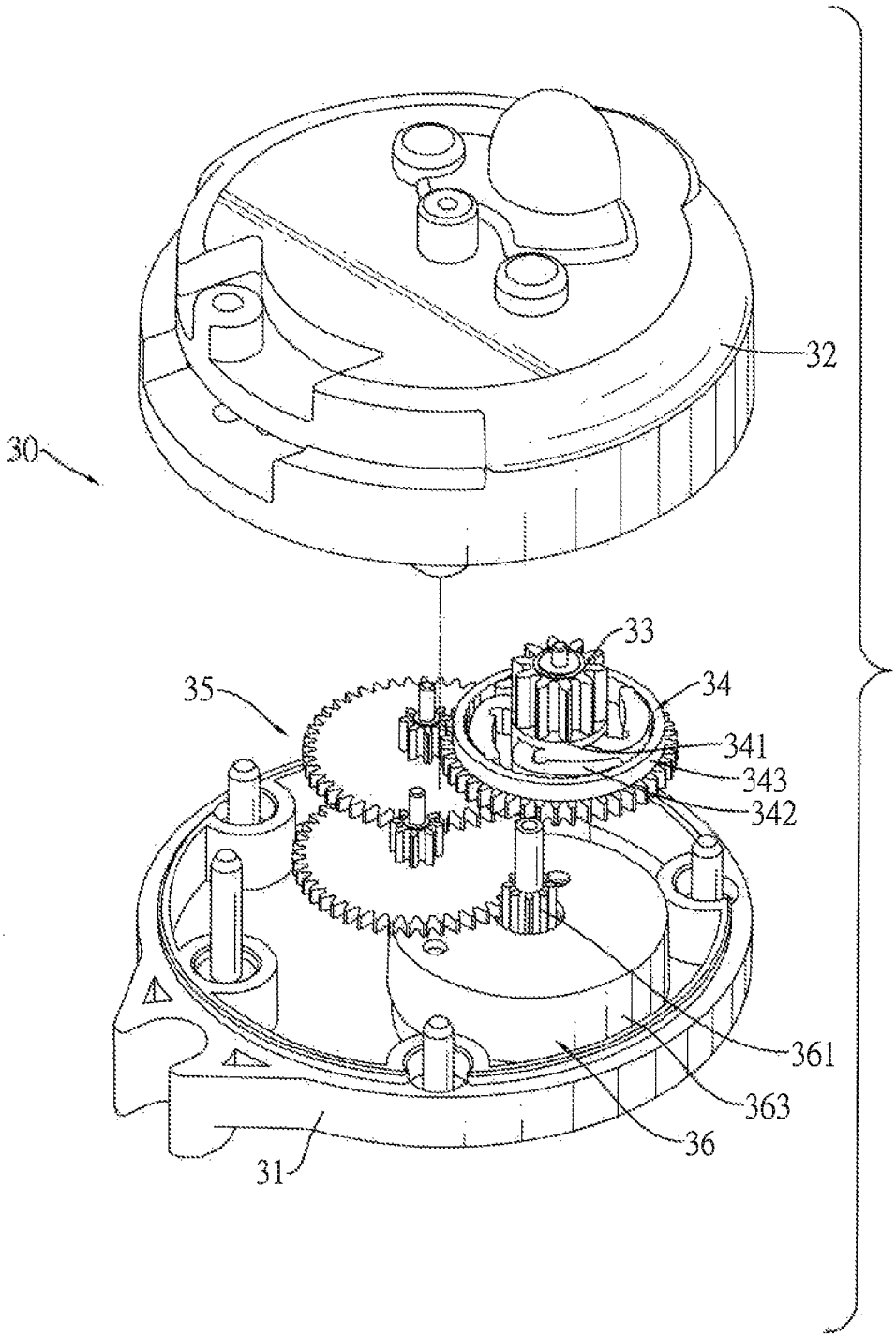
FIG. 10 is an exploded perspective view of a delaying assembly of the retractable safety gate in FIG. 1.
Figure 11:
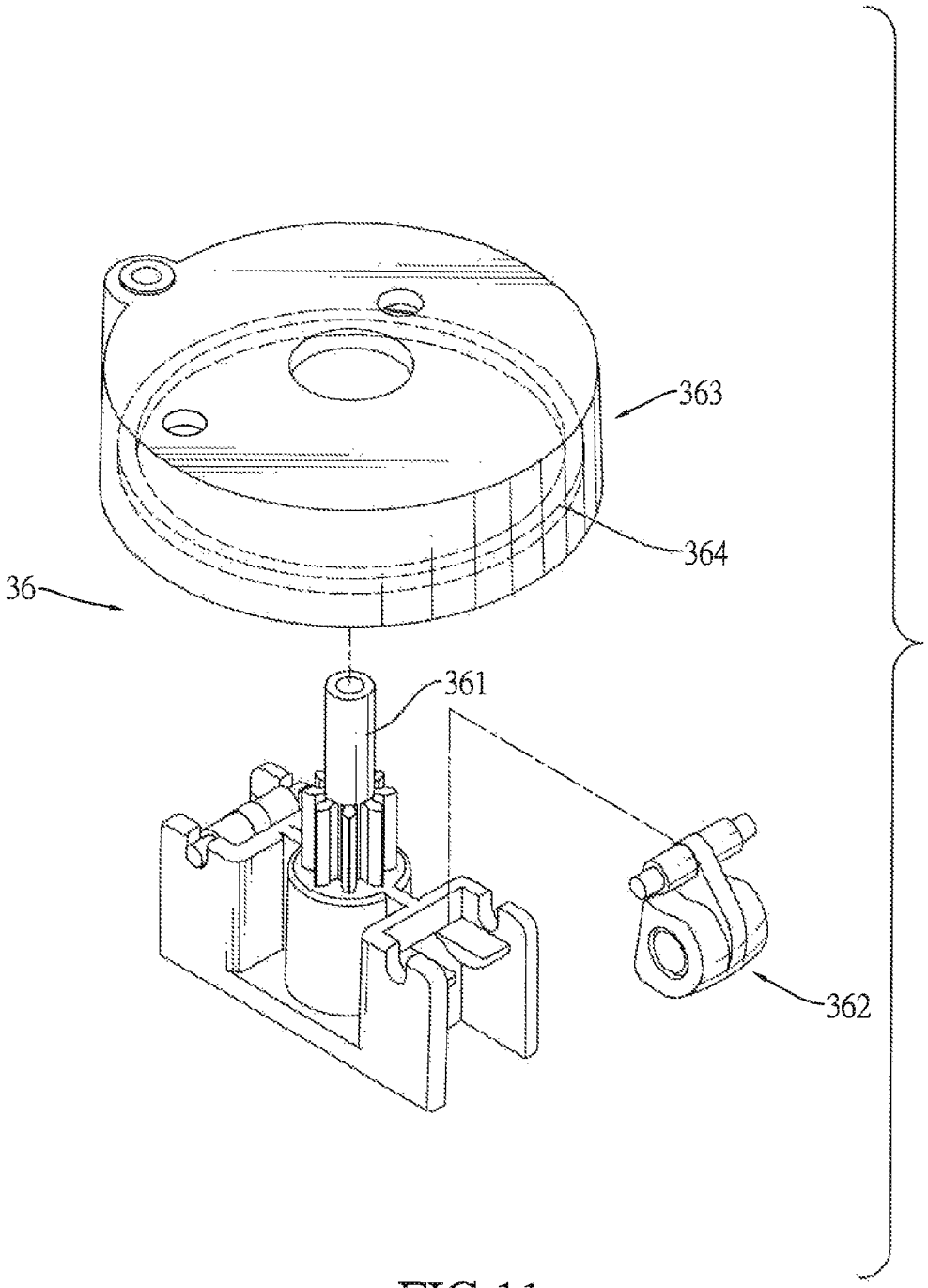
FIG. 11 is an exploded perspective view of a resistance assembly of the delaying assembly of the retractable safety gate in FIG. 1.

With reference to FIGS. 8 to 10, the top cover 111 of the mounting assembly 10 has a surrounding ratchet 115 formed around an inside surface of the top cover 111. The delaying assembly 30 is mounted in the top casing 11 of the mounting assembly 10, is pivotally connected to the top cover 111, and is connected to the controller 22 of the control assembly 20 as shown in FIG. 2. The delaying assembly 30 has a delaying seat 31, a delaying cover 32, an exposed gear 33, a loosening gear assembly 34, an accelerating gear assembly 35 and a resistance assembly 36. The delaying seat 31 is connected to the control pin 223 of the controller 22 of the control assembly 20 as shown in FIG. 2. The delaying cover 32 is mounted on the delaying seat 31. The exposed gear 33 protrudes upward out of the delaying cover 32, and engages with the surrounding ratchet 115 of the top cover 111. The loosening gear assembly 34 has a central unit 341, multiple rack strips 342 and a ring gear 343. The central unit 341 is connected securely to a bottom of the exposed gear 33 and is coaxial to the exposed gear 33. The rack strips 342 are transversely formed on the central unit 341 and are resilient relative to the central unit 341. The ring gear 343 is mounted around and engages with the rack strips 342. The accelerating gear assembly 35 is mounted between the delaying cover 32 and the delaying seat 31, and engages with ring gear 343 and the resistance assembly 36. The accelerating gear assembly 35 has multiple gears, which have different numbers of teeth, and the gears engage with each other to accelerate a rotation rate from the exposed gear 33 to the resistance assembly 36. With reference to FIGS. 10 and 11, the resistance assembly 36 has a driving unit 361, two resistant units 362, a resistant cover 363 and a resistant loop 364. The driving unit 361 is pivotally connected to the delaying seat 31, and engages with the accelerating gear assembly 35. The resistant units 362 are pivotally connected to the driving unit 361, and are disposed on two transversely opposite sides of the driving unit 361. The resistant cover 363 is mounted on the delaying seat 31, and covers the driving unit 361 and the resistant units 362. The resistant loop 364 is mounted around an inside wall of the resistant cover 363.

Figure 12:
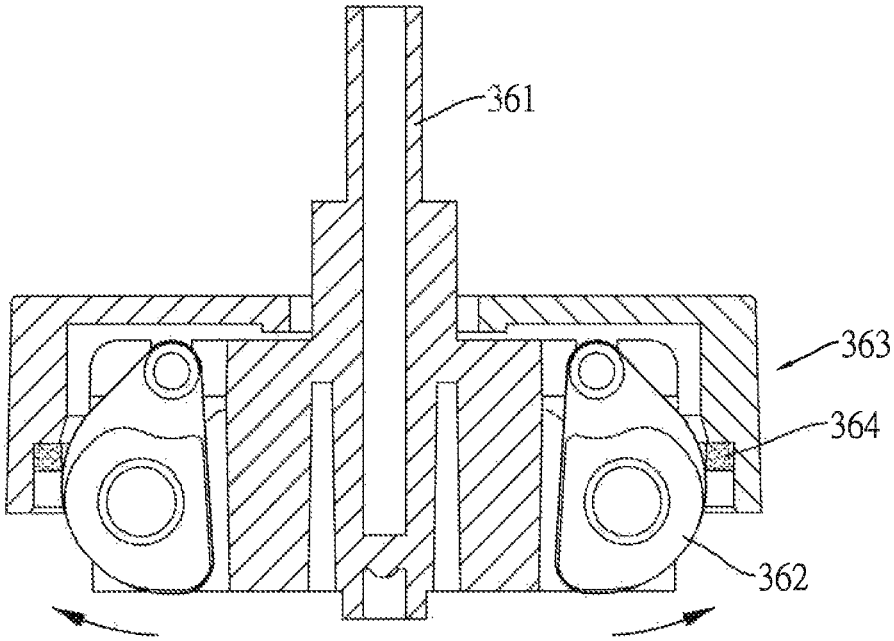
FIG. 12 is an operational view of the resistance assembly of the delaying assembly of the retractable safety gate in FIG. 1, showing resistant units abutting against a resistant loop.

With reference to FIGS. 9 to 12, when the delaying assembly 30 and the top cover 111 rotate each other, because the exposed gear 33 of the delaying assembly 30 engages with the surrounding ratchet 115 of the top cover 111, the exposed gear 33 also rotates. The exposed gear 33 rotates the driving unit 361 of the resistance assembly 36 via the loosening gear assembly 34 and the accelerating gear assembly 35. The accelerating gear assembly 35 accelerates a rotation rate of the resistance assembly 36, and thus the resistance assembly 36 needs bigger force to be actuated at the higher rotation rate, and the weight of the resistance assembly 36 at the higher rotation rate generates a resistance to slow down the relative rotation between the delaying assembly 30 and the top cover 111. Besides, when the driving unit 361 rotates, the resistant units 362 rotate upward relative to the driving unit 361 by a centrifugal force. Then the resistant units 362 may abut against the resistant loop 364 on the inside wall of the resistant cover 363, thereby generating an abrasion force as shown in FIG. 12. The abrasion force slows down the relative rotation between the delaying assembly 30 and the top cover 111 as well. Based on the two technical features mentioned above, the delaying assembly 30 can effectively reduce the relative rotation between the delaying assembly 30 and the top cover 111.

With reference to FIGS. 2, 5 and 10, as mentioned above, when the controller 22 is rotated by an external force, the rotating shaft 14 can rotate freely. Once the external force applied on the controller 22 is removed, the controller 22 is pulled by the spiral spring 24 and rotates back to the original position. The delaying assembly 30 is connected to the control pin 223 of the controller 22, such that the spiral spring 24 pulling back the controller 22 can achieve a function same as the delaying assembly 30 rotating relative to the top cover 111. As a result, the delaying assembly 30 can effectively slow down the spiral spring 24 pulling back the controller 22.

The ring gear 343 of the loosening gear assembly 34 is mounted around and engages with the rack strips 342, and the rack strips 342 are resilient relative to the central unit 341. Thus, when the exposed gear 33 with the central unit 341 rotates too fast, the rack strips 342 are bent relative to the central unit 341 to slide relative to the ring gear 343 and disengage with ring gear 343, such that the accelerating gear assembly 35 and the resistance assembly 36 are not rotated by the ring gear 343. In conclusion, when the exposed gear 33 rotates too fast, the loosening gear assembly 34 stops rotating the accelerating gear assembly 35 to protect the accelerating gear assembly 35 and the resistance assembly 36 from damage caused by even higher rotation rate.

With reference to FIGS. 8 and 9, the top cover 111 of the mounting assembly 10 has an elongated hole 113 and an abutting recess 116. The elongated hole 113 is formed through a front wall of the top cover 111. The abutting recess 116 is axially formed in the top cover 111. The operating assembly 40 is mounted on the top casing 11, is connected to the delaying assembly 30, and has a rotating unit 41, a pressing unit 42, an abutting unit 43 and a second resilient element 44. The rotating unit 41 is mounted through the elongated hole 113 of the top cover 111 and is mounted into the delaying cover 32 of the delaying assembly 30. The pressing unit 42 is disposed below the rotating unit 41, and protrudes upward out of the rotating unit 41. The abutting unit 43 is mounted in the abutting recess 116 of the top cover 111, abuts upward against the pressing unit 42, and is selectively mounted upward into the rotating unit 41. The second resilient element 44 is mounted in the abutting recess 116 of the top cover 111, and abuts upward against the abutting unit 43. In a preferred embodiment, the second resilient element 44 is a spring.

Because the second resilient element 44 pushes upward the abutting unit 43 into the rotating unit 41, the rotating unit 41 cannot move relative to the top cover 111, thereby preventing the rotating unit 41 from being switched on too easily. When the operating assembly 40 is to be switched on, the pressing unit 42 is pressed down. The pressing unit 42 pushes down the abutting unit 43, thereby preventing the abutting unit 43 from protruding out of the abutting recess 116 and into the rotating unit 41. Accordingly, the rotating unit 41 is rotatable. Because the rotating unit 41 is mounted into the delaying cover 32 of the delaying assembly 30, when the rotating unit 41 is rotated, the delaying assembly 30 is rotated by the rotating unit 41, and rotates relatively to the top cover 111. With reference to FIGS. 2, 5 and 8, on the other hand, because the delaying assembly 30 is connected to the control pin 223 of the controller 22, the controller 22 is rotated by the delaying assembly 30, thereby allowing the rotating shaft 14 to rotate freely. Once the force to rotate rotating unit 41 is removed, the spiral spring 24 pulls back the rotating unit 41 to an original position via the controller 22 and the delaying assembly 30. Then, the abutting unit 43 is mounted into the rotating unit 41 again, and the rotating unit 41 cannot move relative to the top cover 111.

Figure 13:
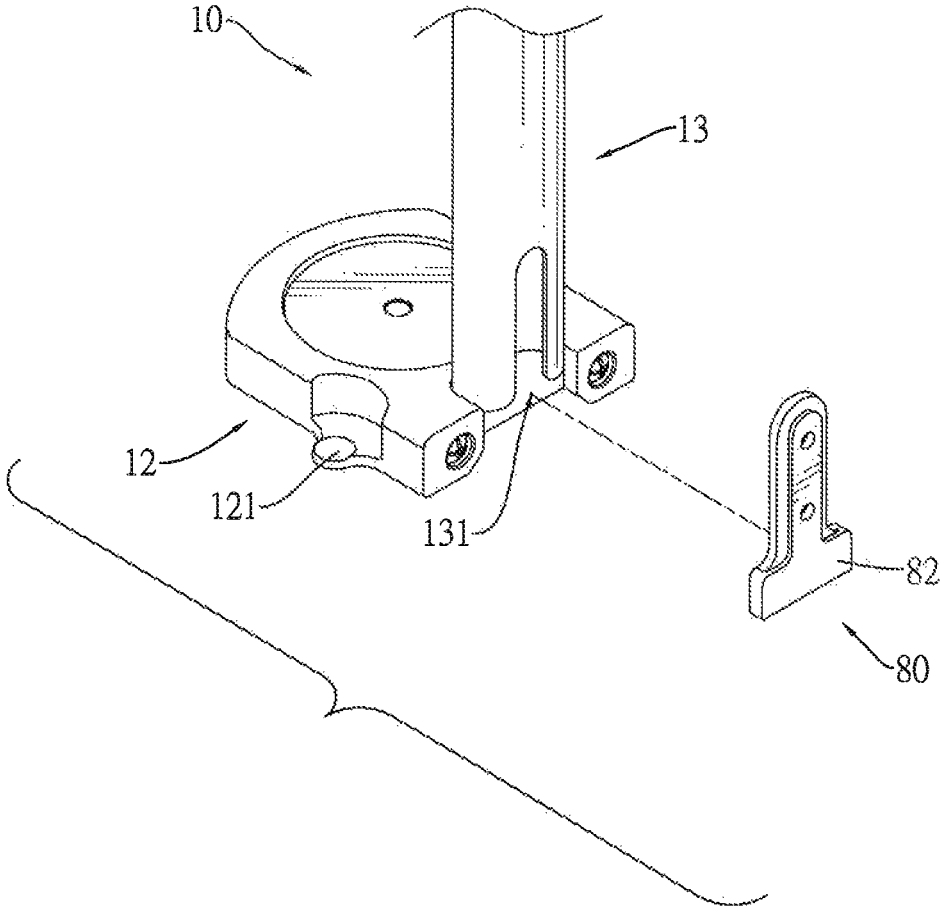
FIG. 13 is another partial exploded perspective view of the retractable safety gate in FIG. 1.

With reference to FIGS. 3, 4 and 13, the top seat 112 of the mounting assembly 10 has a mounting recess 117 and a mounting hole 118. The mounting recess 117 is formed in a back wall of the top seat 112, and communicates with an exterior environment downwardly. The mounting hole 118 is formed through the back wall of the top seat 112 and communicates with the mounting recess 117. The connecting unit 13 of the mounting assembly 10 has an upper recess 132 and a lower recess 131. The upper recess 132 is formed in a back wall of the connecting unit 13 and is adjacent to a top of the connecting unit 13. The lower recess 132 is formed in the back wall of the connecting unit 13, and is adjacent to a bottom of the connecting unit 13. The mounting assembly 10 further has a wall engager 15, a third resilient element 16, a presser 17 and a fourth resilient element 18. The wall engager 15 is mounted in the top seat 112 and has a first end, a second end and an engaging segment 151. The first end of the wall engager 15 is pivotally connected to the top seat 112. The engaging segment 151 is formed backward on the second end of the wall engager 15, and protrudes out of the mounting hole 118 of the top seat 112. The third resilient element 16 is mounted between the wall engager 15 and the top seat 112, and pushes the engaging segment 151 of the wall engager 15 to protrude out of the mounting hole 118 of the top seat 112. In a preferred embodiment, the third resilient element 16 is a spring. The presser 17 is mounted in the top seat 112, is mounted upward through the top cover 111, and has a compressible resilient segment 171. The resilient segment 171 is formed on a bottom of the presser 17, and is mounted in the top seat 112. Thus, a top of the presser 17 can move up and down relative to the top seat 112. The fourth resilient element 18 is mounted between the presser 17 and the top cover 111, and pushes the presser 17 upward to be mounted through the top cover 111. In a preferred embodiment, the fourth resilient element 18 is an expansion spring.

The wall assembly 80 has an upper hanger 81 and a lower hanger 82. The upper hanger 81 is mounted in the mounting recess 117 of the top seat 112, and has an engaging recess 811 and a hanging segment 812. The engaging recess 811 is formed in the upper hanger 81, is adjacent to a top of the upper hanger 81, and is mounted around the engaging segment 151 of the wall engager 15 of the mounting assembly 10. The hanging segment 812 is formed on the upper hanger 81, is adjacent to a bottom of the upper hanger 81, and engages the upper recess 132 of the connecting unit 13. The lower hanger 82 engages the lower recess 131 of the connecting unit 13.

When the wall assembly 80 is installed, the upper hanger 81 and the lower hanger 82 are mounted securely on the wall by screws with a suitable distance between the upper hanger 81 and the lower hanger 82. To mount the mounting assembly 10 on the wall assembly 80, the connecting unit 13 is mounted around the hanging segment 812 of the upper hanger 81 and the lower hanger 82 via the upper recess 132 and the lower recess 131. Then, the connecting unit 13 is pulled down, such that the upper recess 132 and the lower recess 131 each respectively engage the upper hanger 81 and the lower hanger 82. The installation of the wall assembly 80 is accomplished. Because the upper recess 132 and the lower recess 131 each respectively engage the upper hanger 81 and the lower hanger 82, the mounting assembly 10 cannot be separated transversely from the wall assembly 80. Because the wall engager 15 is mounted into the engaging recess 811 of the upper hanger 81, the mounting assembly 10 cannot be separated upward from the wall assembly 80. Thus, the mounting assembly 10 is effectively connected to the wall assembly 80 securely.

When the mounting assembly 10 is to be separated from the wall assembly 80, the presser 17 on the top cover 111 is pressed. The presser 17 moves down and abuts against the wall engager 15. By the inclined surfaces of the presser 17 and the wall engager 15 abutting each other, the presser 17 pushes the wall engager 15 to the front wall of the top seat 112. The wall engager 15 therefore does not protrude out of the mounting hole 118 of the top seat 112, and is not mounted in the engaging recess 811 of the upper hanger 81. Afterwards, the mounting assembly 10 is pulled up, and can be separated transversely from the wail assembly 80.

Figure 14:
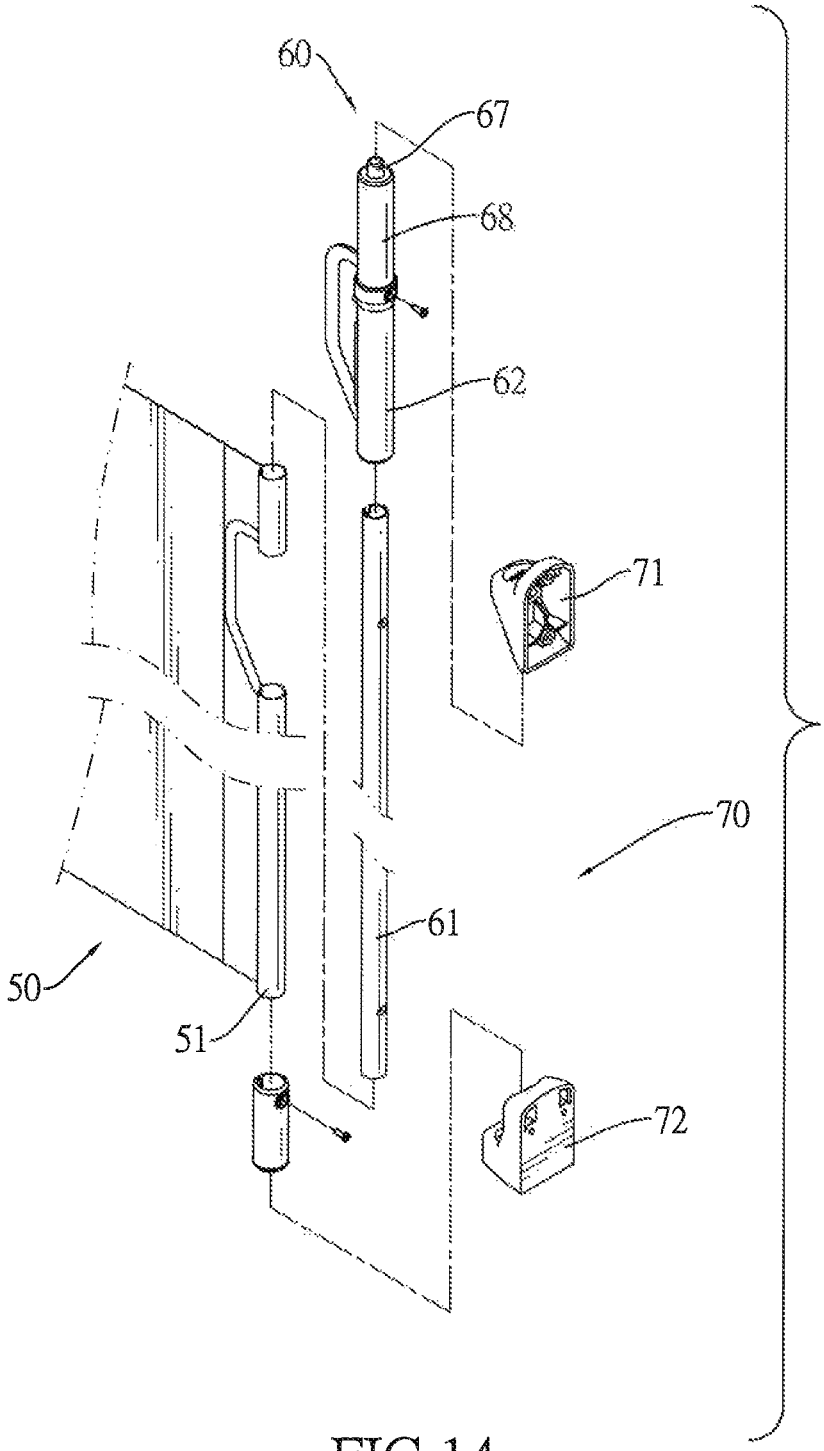
FIG. 14 is an exploded perspective view of a grip assembly of the retractable safety gate in FIG. 1.
Figure 15:
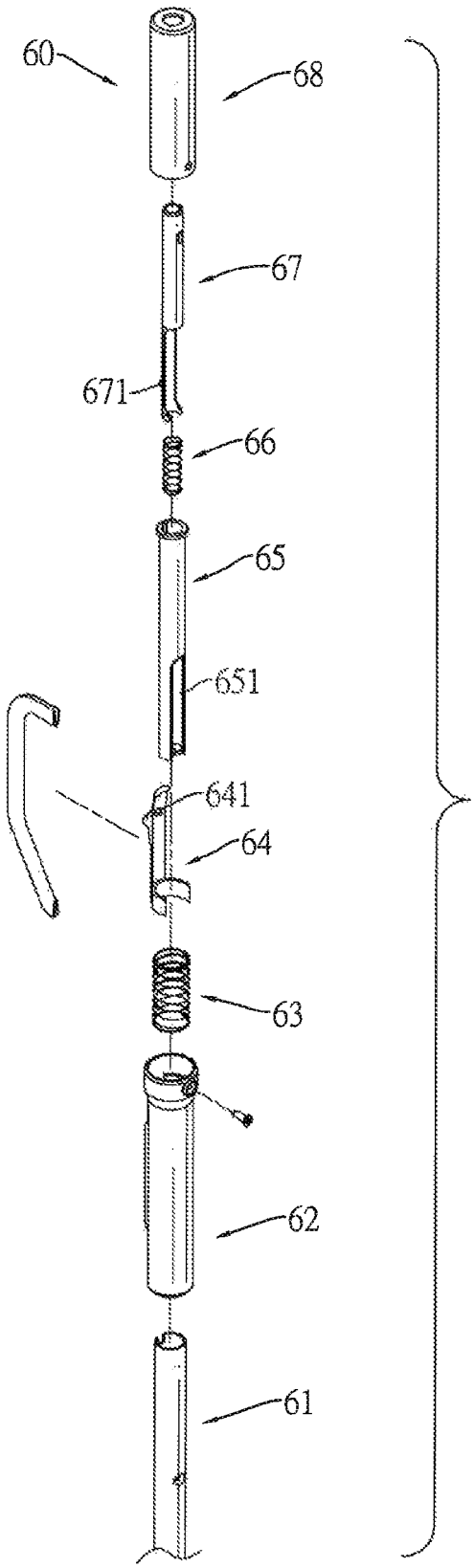
FIG. 15 is a side view in partial section of the grip assembly of the retractable safety gate in FIG. 1.
Figure 16:
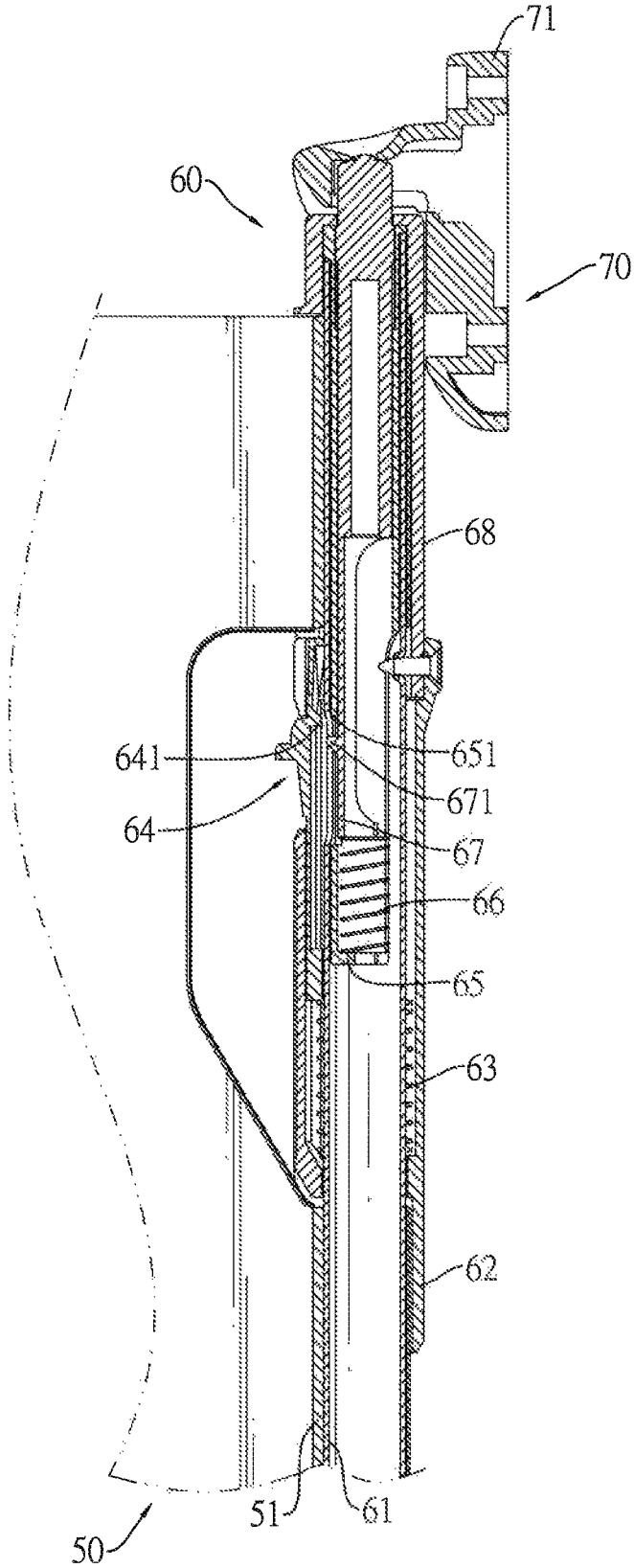
FIG. 16 is an operational view of the retractable safety gate in FIG. 1, showing the mounting assembly and the wall assembly connecting to each other.

With reference to FIGS. 14 to 16, the blocking cloth 50 is connected to the mounting assembly 10, and has a first side, a second side and a mounting tube 51. The first side of the blocking cloth 50 is connected to the rotating shaft 14 of the mounting assembly 10 as shown in FIG. 2. The mounting tube 51 is mounted on the second side of the blocking cloth 50. The grip assembly 60 is mounted in the mounting tube 51 of the blocking cloth 50, and has a main shaft 61, a bottom tube 62, a fifth resilient element 63, an operating unit 64, an inner tube 65, a sixth resilient element 66, a top tube 68 and a top engager 67. The main shaft 61 is mounted securely in the mounting tube 51. The bottom tube 62 is mounted on a top of the main shaft 61. The fifth resilient element 63 is mounted in and abuts downward against the bottom tube 62. In a preferred embodiment, the fifth resilient element 63 is a spring. The operating unit 64 is mounted in the bottom tube 62, abuts downward against the fifth resilient element 63, and has an operating protrusion 641. The operating protrusion 641 is formed on an inside wall of the operating unit 64. The inner tube 65 is mounted securely in the bottom tube 62, is mounted in the operating unit 64, and has two elongated openings 651. The elongated openings 651 are formed through the inner tube 65, and are disposed opposite to each other. The sixth resilient element 66 is mounted in and abuts downward against the inner tube 65. In a preferred embodiment, the sixth resilient element is a spring. The top tube 68 is mounted around the inner tube 65, and is mounted securely to the bottom tube 62. The top engager 67 is mounted in the inner tube 65, abuts downward against the sixth resilient element 66, and has a top protrusion 671. The top protrusion 671 is formed on an outside wall of the top engager 67, corresponds to the operating protrusion 641 of the operating unit 64, and protrudes upward out of the top tube 68.

The receiving assembly 70 is disposed opposite to the mounting assembly 10, and is selectively connected securely to the grip assembly 60. The receiving assembly 70 has an upper receiver 71 and a lower receiver 72. The bottom of the upper receiver 71 is an inclined surface, and the upper receiver 71 has a recess. The recess of the upper receiver 71 is formed in the bottom of the upper receiver 71, and is selectively mounted around the top engager 67 of the grip assembly 60. The lower receiver 72 has a recess. The recess of the lower receiver 72 is formed in a top of the lower receiver 72, and is selectively mounted around a bottom of the grip assembly 60.

When the receiving assembly 70 is installed, the upper receiver 71 and the lower receiver 72 are mounted securely on the wall by screws with a suitable distance between the upper receiver 71 and the lower receiver 72. The installation of the receiving assembly 70 is thus accomplished.

When the grip assembly 60 on the blocking cloth 50 is to be connected to the receiving assembly 70, the bottom of the grip assembly 60 is mounted into the recess of the lower receiver 72. Then, the top engager 67, protruding upward out of the grip assembly 60, moves and abuts along the inclined bottom of the upper receiver 71. During the movement, the top engager 67 is pressed by the inclined bottom of the upper receiver 71, such that the top engager 67 is pressed down relative to the top tube 68, and presses the sixth resilient element 66. After the top engager 67 moves to the recess of the upper receiver 71, the sixth resilient element 66 pushes up the top engager 67 to the recess of the upper receiver 71. Because a top and the bottom of the grip assembly 60 are each respectively mounted into the recesses of the upper receiver 71 and the lower receiver 72, the grip assembly 60 with the blocking cloth 50 is connected securely to the receiving assembly 70.

When the grip assembly 60 is to be separated from the receiving assembly 70, the operating unit 64 is pushed inside until the operating protrusion 641 of the operating unit 64 is disposed above the top protrusion 671 of the top engager 67. Then the operating unit 64 is pushed down, and the top engager 67 is pushed down by the operating protrusion 641 abutting downward against the top protrusion 671. After the top engager 67 is disengaged from the recess of the upper receiver 71, the grip assembly 60 is slightly inclined and then can be separated from the upper receiver 71 and the lower receiver 72.

Figure 17:
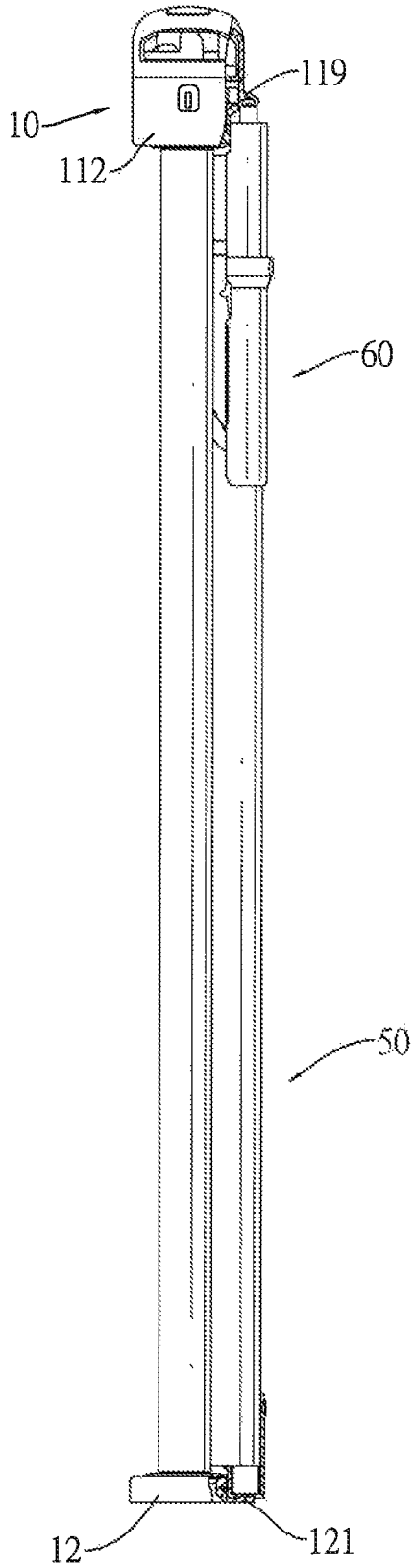
FIG. 17 is an operational view of the retractable safety gate in FIG. 1, showing the grip assembly and the mounting assembly connecting to each other.

With reference to FIGS. 3, 13 and 17, the top seat 112 has an upper connector 119 and a recess. The upper connector 119 is formed on an outside wall of the top seat 112. The recess of the top seat 112 is formed in a bottom of the upper connector 119, and is selectively mounted around the top engager 67 of the grip assembly 60. The bottom casing 12 has a lower connector 121 and a recess. The lower connector 121 is formed on an outside wall of the bottom casing 12. The recess of the bottom casing 12 is formed in a top of the lower connector 121, and is selectively mounted around the bottom of the grip assembly 60.

With reference to FIGS. 2, 3 and 8, to sum up, the retractable safety gate is installed simply by making the mounting assembly 10 engaging with the wall assembly 80. When the retractable safety gate is to be separated from the wall, the presser 17 on the top casing 11 is pressed so that the mounting assembly 10 can be separated from the wall assembly 80.

With reference to FIGS. 2, 5, 8 and 14, when the blocking cloth 50 is to be pulled out from the retracted status, the pressing unit 42 is pressed, and the rotating unit 41 is rotated. Then the rotating unit 41 rotates the controller 22 of the control assembly 20 via the delaying unit 30, such that the controller 22 pushes out the first arm 25 and the second arm 26 to allow the ratchet unit 23 with the rotating shaft 14 of the mounting assembly 10 to rotate freely. Therefore, the blocking cloth 50, which is connected to the rotating shaft 14, can be pulled out, and the grip assembly 60 can be connected into the receiving assembly 70 to divide a room into two separate spaces.

When the blocking cloth 50 is pulled, the ratchet unit 23 is also pulled by the spiral spring 24, and the blocking cloth 50 is retracted automatically if the user stops pulling the block cloth 50 before the grip assembly 60 is connected securely to the receiving assembly 70. When the retractable safety gate as described is not in use, the operating unit 64 of the grip assembly 60 is pushed inside and down as shown in FIG. 16, such that the grip assembly 60 can be separated from the receiving assembly 70. Then the user reduces the pulling force on the blocking cloth 50, and the blocking cloth 50 is slowly retracted to the mounting assembly 10. Finally, the top and the bottom of the grip assembly 60 are each respectively mounted in the upper connector 119 of the top casing 11 and the lower connector 121 of the bottom casing 12 as shown in FIG. 17. The retraction of the blocking cloth 50 is accomplished.

Besides, two ends of the spiral spring 24 are each respectively connected to the controller 22 and the ratchet unit 23. Thus, after the user stops rotating the rotating unit 41 of the operating assembly 40, the controller 22 with the rotating unit 41 and the delaying assembly 30 are pulled back to the original position by the spiral spring 24. Because the delaying assembly 30 reduces the relative rotation between the delaying assembly 30 and the top cover 111, the delaying assembly 30 also slows down the controller 22 rotating back. During the backward rotation of the controller 22, the user can pull the blocking cloth 50 freely to be connected securely to the receiving assembly 70, or the user can leave the blocking cloth 50 retracted back. After the blocking cloth 50 is connected securely to the receiving assembly 70 or is retracted, the user can release grasp of the blocking cloth 50. After the controller 22 rotates back to the original position, the first arm 25 and the second arm 26 engages with the ratchet unit 23 again, such that the ratchet unit 23 with the rotating shaft 14 and the blocking cloth 50 cannot rotate.

With reference to FIGS. 2, 5, 8 and 10, when the user presses the pressing unit 42 and rotates the rotating unit 41, if the user rotates the rotating unit 42 too fast, the loosening gear assembly 34 of the delaying assembly 30 is switched on to stop rotating the accelerating gear assembly 35, thereby protecting gears of the delaying assembly 30 from damage caused by rotating too fast. Besides, when the rotating unit 41 is rotated to the other end portion of the curved hole 211 and starts to rotate back, if the user forces to rotate back the rotating unit 41, the loosening gear assembly 34 is also switched on. In addition, the rotating unit 41 is mounted into the delaying cover 32, and the delaying seat 31 is connected securely to the controller 22. Thus, no matter in which direction the loosening gear assembly 34 acts, the controller 22 still rotates with the rotating unit 41. The loosening gear assembly 34 only temporarily disables the delaying assembly 30 from generating resistance to protect the components from being damaged. The loosening gear assembly 34 does not affect the whole action of the retractable safety gate.

The retractable safety gate as described has the following advantages. In the control assembly 20, because the spiral spring 24 is connected between the controller 22 and the ratchet unit 23, the controller 22 is pulled back to the original position to be closed by the spiral spring 24. Compared with the conventional retractable safety gate that has a torsion spring to make the control assembly move back, the retractable safety gate as described reduces number of the components and has a simplified structure.

In the resistance assembly 36 of the delaying assembly 30, the resistant units 362 rotate upward relative to the driving unit 361 by centrifugal force to abut against the resistant loop 364 to generate the abrasion force. Compared with the conventional retractable safety gate using fan blades or flywheel weights, the retractable safety gate as described has a simplified structure.

In the mounting assembly 10, the elongated connecting unit 13 replaces the conventional elongated casing, such that the retractable safety gate as described can be reduced in volume and lowers the cost. The wall engager 15, the third resilient element 16, the presser 17 and the fourth resilient element 18 also simplify the connecting structure to the wall assembly 80.

To sum up, the retractable safety gate as described has a simplified structure and lowers the cost.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A retractable safety gate comprising:

a mounting assembly having a top casing having an elongated hole formed through the top casing;

a bottom casing disposed below the top casing;

a connecting unit connected between the top casing and the bottom casing; and a rotating shaft rotatably connected between the top casing and the bottom casing;

a control assembly mounted in the top casing and having a control seat mounted securely in the top casing;

a controller pivotally connected to the control seat and having a first protrusion and a second protrusion formed separately on an outside wall of the controller;

a ratchet unit pivotally connected to the controller, connected securely to the rotating shaft of the mounting assembly, and having a first loop ratchet formed on an outside wall of the ratchet unit; and a second loop ratchet formed on the outside wall of the ratchet unit, and formed below the first loop ratchet; wherein a rotating direction of the second loop ratchet is reverse to a rotating direction of the first loop ratchet;

a spiral spring connected between the controller and the ratchet unit;

a first arm pivotally connected to the controller and having a first engager formed axially on the first arm, and selectively abutting the first protrusion of the controller; and a first stopper formed transversely on an inside wall of the first arm, and selectively engaging with the first loop ratchet of the ratchet unit;

a second arm pivotally connected to the controller and having a second engager formed axially on the second arm, and selectively abutting the second protrusion of the controller; and a second stopper formed transversely on an inside wall of the second arm, and selectively engaging with the second loop ratchet of the ratchet unit; and two first resilient elements, and two sides of one of the first resilient elements each respectively abutting the control seat and the first arm, and two sides of the other first resilient element each respectively abutting the control seat and the second arm;

a delaying assembly mounted in the top casing, pivotally connected to the top casing, and connected to the controller of the control assembly;

an operating assembly mounted on the top casing, connected to the delaying assembly, and having a rotating unit mounted through the elongated hole of the top casing, and connected to the delaying assembly;

a blocking cloth connected to the mounting assembly, and having a first side connected to the rotating shaft of the mounting assembly; and a second side;

a grip assembly mounted on the second side of the blocking cloth; and a receiving assembly disposed opposite to the mounting assembly, and selectively connected securely to the grip assembly;

wherein in the control assembly, when the first protrusion does not abut the first engager and when the second protrusion does not abut the second engager, the first stopper and the second stopper each respectively engage the first loop ratchet and the second loop ratchet of the ratchet unit by the first resilient elements to stop the ratchet unit from rotating in two reverse directions;

wherein in the control assembly, when the first protrusion abuts the first engager and when the second protrusion abuts the second engager, the first stopper and the second stopper each respectively disengage from the ratchet unit to allow the ratchet unit to rotate freely.

2. The retractable safety gate as claimed in claim 1, wherein the top casing has a top cover; wherein the elongated hole is formed in the top cover;

a top seat; and an inner space formed between the top cover and the top seat; wherein the control assembly and the delaying assembly are mounted between the top cover and the top seat.

3. The retractable safety gate as claimed in claim 2, wherein the top seat of the top casing has a display hole formed through the top seat; and the controller of the control assembly has a first displaying segment formed on the outside wall of the controller and corresponding to the display hole of the top seat; and a second displaying segment formed on the outside wall of the controller, corresponding to the display hole of the top seat, and being transversely adjacent to the first displaying segment; wherein a color of the first displaying segment is different from a color of the second displaying segment.

4. The retractable safety gate as claimed in claim 3, wherein the control seat of the control assembly has a curved hole formed through the control seat; and the controller has a control pin formed axially on the controller, mounted through the curved hole of the control seat, and connected to the delaying assembly.

5. The retractable safety gate as claimed in claim 4, wherein the top cover has a surrounding ratchet formed around an inside surface of the top cover; and the delaying assembly has a delaying seat connected to the control pin of the controller of the control assembly;

a delaying cover mounted on the delaying seat;

an exposed gear protruding out of the delaying cover, and engaging with the surrounding ratchet of the top cover;

an accelerating gear assembly mounted between the delaying cover and the delaying seat, and engaging with the exposed gear; and a resistance assembly engaging with the accelerating gear assembly.

6. The retractable safety gate as claimed in claim 5, wherein the resistance assembly of the delaying assembly has a driving unit pivotally connected to the delaying seat, and engaging with the accelerating gear assembly;

two resistant units pivotally connected to the driving unit, and disposed on two opposite sides of the driving unit;

a resistant cover mounted on the delaying seat, and covering the driving unit and the resistant units; and a resistant loop mounted around an inside wall of the resistant cover.

7. The retractable safety gate as claimed in claim 6, wherein the top cover has an abutting recess formed in the top cover; and the operating assembly has a pressing unit disposed below the rotating unit, and protruding upward out of the rotating unit;

an abutting unit mounted in the abutting recess of the top cover, abutting upward against the pressing unit, and selectively mounted upward into the rotating unit; and a second resilient element mounted in the abutting recess of the top cover, and abutting upward against the abutting unit.

8. The retractable safety gate as claimed in claim 7 further comprising a wall assembly, wherein the top seat has a mounting recess formed in a back wall of the top seat, and communicating with an exterior environment downwardly; and a mounting hole formed through the back wall of the top seat, and communicating with the mounting recess;

the connecting unit of the mounting assembly has an upper recess formed in a back wall of the connecting unit, and being adjacent to a top of the connecting unit; and a lower recess formed in the back wall of the connecting unit, and being adjacent to a bottom of the connecting unit;

the mounting assembly has a wall engager mounted in the top seat, and having a first end pivotally connected to the top seat;

a second end; and an engaging segment formed backward on the second end of the wall engager, and protruding out of the mounting hole of the top seat;

a third resilient element mounted between the wall engager and the top seat, and pushing the engaging segment of the wall engager to protrude out of the mounting hole of the top seat;

a presser mounted in the top seat, mounted upward through the top cover, and having a compressible resilient segment formed on a bottom of the presser, and mounted in the top seat; and a fourth resilient element mounted between the presser and the top casing, and pushing the presser upward to be mounted through the top cover; and the wall assembly has an upper hanger mounted in the mounting recess of the top seat, and having an engaging recess formed in the upper hanger, being adjacent to a top of the upper hanger, and mounted around the engaging segment of the wall engager of the mounting assembly; and a hanging segment formed on the upper hanger, being adjacent to a bottom of the upper hanger, and engaging the upper recess of the connecting unit; and a lower hanger engaging the lower recess of the connecting unit.

9. The retractable safety gate as claimed in claim 8, wherein the blocking cloth has a mounting tube mounted on the second side of the blocking cloth;

the grip assembly is mounted in the mounting tube and has a main shaft mounted securely in the mounting tube;

a bottom tube mounted on a top of the main shaft;

a fifth resilient element mounted in and abutting downward against the bottom tube;

an operating unit mounted in the bottom tube, abutting downward against the fifth resilient element, and having an operating protrusion formed on an inside wall of the operating unit;

an inner tube mounted securely in the bottom tube, mounted in the operating unit, and having two elongated openings formed through the inner tube, and disposed opposite to each other;

a sixth resilient element mounted in and abutting downward against the inner tube;

a top tube mounted around the inner tube, mounted securely to the bottom tube; and a top engager mounted in the inner tube, abutting downward against the sixth resilient element, and having a top protrusion formed on an outside wall of the top engager, corresponding to the operating protrusion of the operating unit, and protruding upward out of the top tube; and the receiving assembly has an upper receiver selectively mounted around the top engager of the grip assembly; and a lower receiver selectively mounted around a bottom of the grip assembly.

10. The retractable safety gate as claimed in claim 9, wherein the top seat has an upper connector formed on an outside wall of the top seat; and a recess formed in a bottom of the upper connector, and selectively mounted around the top engager of the grip assembly; and the bottom casing has a lower connector formed on an outside wall of the bottom casing; and a recess formed in a top of the lower connector, and selectively mounted around the bottom of the grip assembly.

* * * * *